US008824938B2

(12) United States Patent
Nakayama et al.

(10) Patent No.: US 8,824,938 B2
(45) Date of Patent: Sep. 2, 2014

(54) IMAGE FORMING APPARATUS

(75) Inventors: Kanji Nakayama, Toyokawa (JP); Masayasu Haga, Toyokawa (JP); Tomohisa Yoshida, Toyokawa (JP); Wataru Onoda, Toyokawa (JP); Narutaka Yoshida, Toyokawa (JP); Noboru Ito, Kawanishi (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 392 days.

(21) Appl. No.: 13/344,022

(22) Filed: Jan. 5, 2012

(65) Prior Publication Data

US 2012/0177416 A1 Jul. 12, 2012

(30) Foreign Application Priority Data

Jan. 7, 2011 (JP) ..... 2011-002127

(51) Int. Cl.
*G03G 15/08* (2006.01)
*G03G 15/09* (2006.01)

(52) U.S. Cl.
USPC ..... 399/285; 399/267; 399/270

(58) Field of Classification Search
USPC ..... 399/267, 270, 277, 285
See application file for complete search history.

(56) References Cited

U.S. PATENT DOCUMENTS 5,239,342 A * 8/1993 Kubo et al. ..... 430/122.7
5,440,378 A * 8/1995 Matsuura ..... 399/267
5,442,425 A * 8/1995 Yokoyama et al. ..... 399/276
5,953,570 A * 9/1999 Hirai ..... 399/282
6,721,526 B2 4/2004 Shigeta et al.
6,819,901 B1 * 11/2004 Yasutomi et al. ..... 399/277
7,095,971 B2 * 8/2006 Ozeki et al. ..... 399/267
7,127,199 B2 * 10/2006 Imamura et al. ..... 399/277
7,362,990 B2 4/2008 Itagaki et al.

(Continued)

FOREIGN PATENT DOCUMENTS

JP 5-006099 A 1/1993
JP 6-118798 A 4/1994

(Continued)

OTHER PUBLICATIONS

Office Action (Notification of Reasons for Refusal) dated Feb. 19, 2013, issued by the Japanese Patent Office in corresponding Japanese Patent Application No. 2011-002127, and an English translation thereof. (7 pages).

*Primary Examiner* — David Bolduc
(74) *Attorney, Agent, or Firm* — Buchanan Ingersoll & Rooney PC

(57) ABSTRACT

An image forming apparatus, wherein the packing density at a closest point where the first peripheral surface and the second peripheral surface are the closest to each other is within a range from 0.3 to 0.4; wherein a maximum magnetic flux density of a principal magnetic pole for generating the magnetic field for development is located in an upstream side from the closest point with respect to the specified direction and at a point where the packing density is equal to or greater than 0.2; and wherein a magnetic flux density of the principal magnetic pole at a point where the packing density is 0.2 in a downstream side from the closest point with respect to the specified direction is equal to or less than ½ of a magnetic flux density of the principal magnetic pole at a point where the packing density is 0.2 in the upstream side.

2 Claims, 7 Drawing Sheets

(56) References Cited

U.S. PATENT DOCUMENTS

| | | | | |
|---|---|---|---|---|
| 2002/0009312 | A1* | 1/2002 | Sugimoto et al. | 399/270 |
| 2002/0028092 | A1* | 3/2002 | Ariizumi et al. | 399/267 |
| 2002/0168200 | A1* | 11/2002 | Stelter et al. | 399/267 |
| 2006/0029435 | A1* | 2/2006 | Kasai et al. | 399/267 |
| 2006/0067741 | A1* | 3/2006 | Azami | 399/267 |
| 2006/0133857 | A1* | 6/2006 | Itagaki et al. | 399/267 |
| 2006/0228135 | A1* | 10/2006 | Miyoshi | 399/277 |
| 2008/0298850 | A1* | 12/2008 | Maezawa et al. | 399/277 |

FOREIGN PATENT DOCUMENTS

| | | | |
|---|---|---|---|
| JP | 6-194961 | A | 7/1994 |
| JP | 2003-177608 | A | 6/2003 |
| JP | 2004-348029 | A | 12/2004 |
| JP | 2006-091247 | A | 4/2006 |
| JP | 2006-201750 | A | 8/2006 |
| JP | 2006-243120 | A | 9/2006 |
| JP | 2008-191604 | A | 8/2008 |
| JP | 2009-098593 | A | 5/2009 |
| JP | 2009-139707 | A | 6/2009 |

* cited by examiner

IMAGE FORMING APPARATUS

This application is based on Japanese Patent Application No. 2011-002127 filed on Jan. 7, 2011, the content of which is herein incorporated by reference.

BACKGROUND OF THE INVENTION

1. Field of the Invention

The present invention relates to an image forming apparatus, and more particularly to an image forming apparatus for forming a toner image on a print medium with a developer composed of toner and carriers.

2. Description of Related Art

As a conventional image forming apparatus, for example, an image forming apparatus disclosed by Japanese Patent Laid-Open Publication No. 2009-98593 is known. The image forming apparatus adopts a DC development method, wherein development is performed by applying a DC voltage between a developer support member and an image support member. In the image forming apparatus disclosed by Japanese Patent Laid-Open Publication No. 2009-98593, since the DC development is adopted, it is not necessary to apply an AC voltage between the developer support member and the image support member. Therefore, the structure of the image forming apparatus can be simple.

However, the image forming apparatus adopting the DC development method has a problem that toner images formed thereby are more prone to density unevenness than toner images formed by image forming apparatuses adopting an AC development method.

In the AC development method, generally, a voltage with an amplitude of about 700V is applied between a developer support member and an image support member. In this case, since a relatively high voltage is applied between the developer support member and the image support member, a relatively large amount of toner contributes to development. Therefore, in an image forming apparatus adopting the AC development method, even if the gap between the developer support member and the image support member fluctuates due to non-uniform rotations of the developer support member and the image support member, it is less likely that toner images formed thereby have density unevenness.

In the DC development method, on the other hand, a DC voltage of about 150V is applied between a developer support member and an image support member. In this case, since a relatively low voltage is applied between the developer support member and the image support member, only a relatively small amount of toner contributes to development. Therefore, in an image forming apparatus adopting the DC development method, if the gap between the developer support member and the image support member fluctuates due to non-uniform rotations of the developer support member and the image support member, toner images formed thereby are prone to density unevenness.

The image forming apparatus also adopts a counter development method. In the counter development method, the developer support member and the image support member rotate in the same direction, whereby the developer support member and the image support member travel in the opposite direction at a position to face to each other. In the image forming apparatus disclosed by Japanese Patent Laid-Open Publication No. 2009-98593, since the counter development method is adopted, more toner comes into contact with an electrostatic latent image formed on the image support member. Therefore, it is less likely that toner images formed by the image forming apparatus have density unevenness.

However, the image forming apparatus disclosed by Japanese Patent Laid-Open Publication No. 2009-98593 has still the following problem. Since the developer support member and the image support member travel in the opposite direction at a position to face to each other, carriers of the developer come into contact with the formed toner image, which may cause stripe noise in the trailing edge of the toner image.

SUMMARY OF THE INVENTION

An object of the present invention is to provide an image forming apparatus that prevents toner images formed thereby from having density unevenness and stripe noise.

An image forming apparatus according to an embodiment of the present invention is an image forming apparatus for forming a toner image on a print medium with a developer composed of toner and carriers, and the image forming apparatus comprises: an image support member having a first peripheral surface for supporting an electrostatic latent image thereon, the first peripheral surface traveling in a specified direction in a development area; a developing device comprising a developer support member having a second peripheral surface for supporting the developer thereon, the second peripheral surface traveling in a direction opposite to the first peripheral surface in the development area, the developer support member attracting the carriers of the developer by an effect of a magnetic field so as to hold the developer on the second peripheral surface; and a voltage applying device for applying a DC voltage to the second peripheral surface such that in the development area, the electrostatic latent image supported on the first peripheral surface is developed with the developer supported on the second peripheral surface; wherein when a value calculated by performing a first division of an amount of the developer adhering to a unit area of the second peripheral surface by a density of the developer and further by performing a second division of a value resulting from the first division by a gap between the first peripheral surface and the second peripheral surface is defined as a packing density, the packing density at a closest point where the first peripheral surface and the second peripheral surface are the closest to each other is within a range from 0.3 to 0.4; wherein a maximum magnetic flux density of a principal magnetic pole for generating the magnetic field for development is located in an upstream side that is a side upstream from the closest point with respect to the specified direction and at a point where the packing density is equal to or greater than 0.2; and wherein a magnetic flux density of the principal magnetic pole at a point where the packing density is 0.2 in a downstream side that is a side downstream from the closest point with respect to the specified direction is equal to or less than ½ of a magnetic flux density of the principal magnetic pole at a point where the packing density is 0.2 in the upstream side.

BRIEF DESCRIPTION OF THE DRAWINGS

This and other objects and features of the present invention will be apparent from the following description with reference to the accompanying drawings, in which.

DETAILED DESCRIPTION OF THE PREFERRED EMBODIMENTS

An image forming apparatus according to an embodiment of the present invention will be hereinafter described with reference to the accompanying drawings.

Structure of the Image Forming Apparatus

Figure 1:
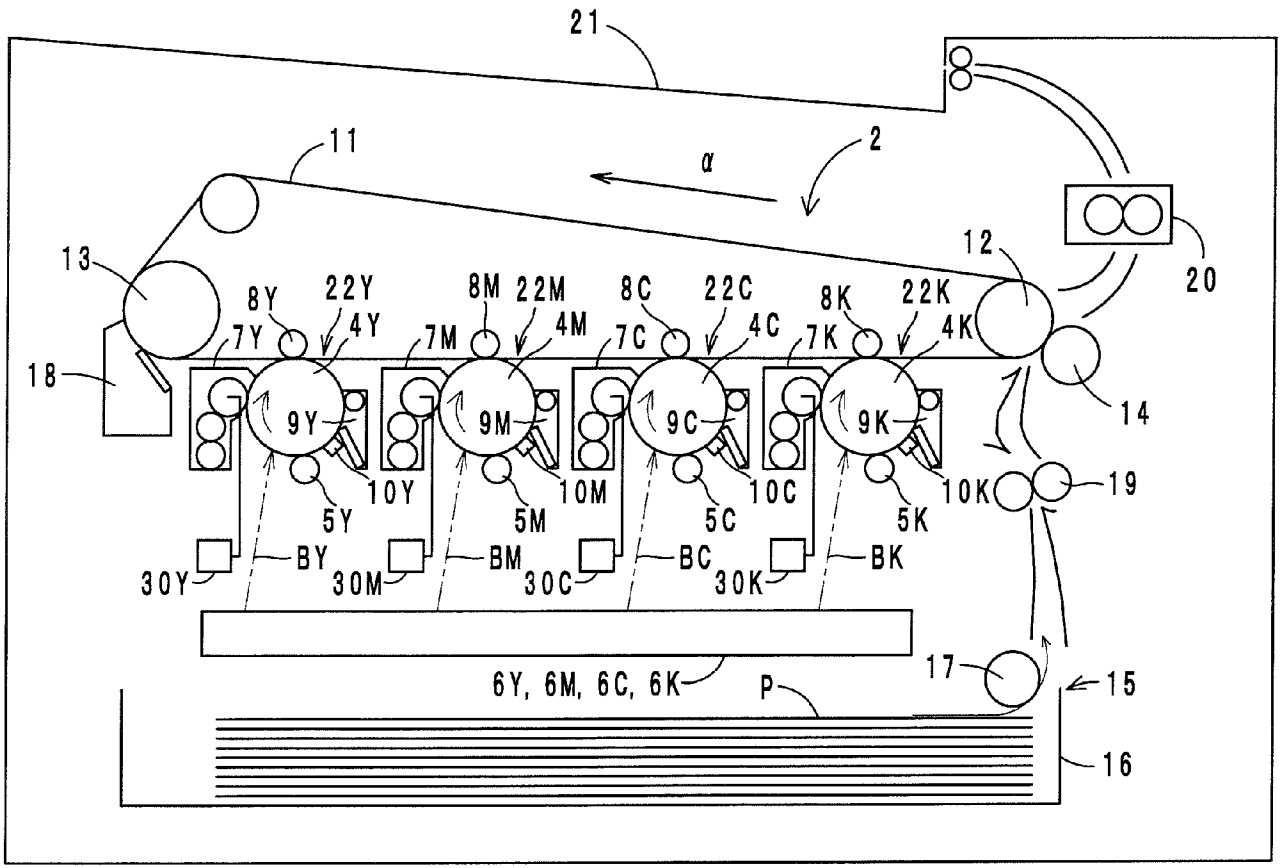
FIG. 1 is a skeleton framework of an image forming apparatus.

FIG. 1 shows the overall structure of the image forming apparatus 1 according to an embodiment of the present invention.

The image forming apparatus 1 is an electrophotographic color printer and combines images of four colors, namely, yellow (Y), magenta (M), cyan (C) and black (K) by a tandem method. The image forming apparatus 1 forms a toner image in accordance with image data read out by a scanner on a sheet (print medium) P with a developer composed of toner and magnetic carriers. As shown in FIG. 1, the image forming apparatus 1 comprises a printing section 2, a feeding section 15, a pair of timing rollers 19, a fixing device 20 and a printed-sheet tray 21.

The feeding section 15 feeds sheets P one by one. The feeding section 15 comprises a sheet tray 16 and a feed roller 17. On the sheet tray 16, a plurality of sheets P to be subjected to printing are stacked. The feed roller 17 picks up one sheet from the stack of sheets P on the sheet tray 16. The pair of timing rollers 19 feeds the sheet P in synchronized timing so that a toner image can be transferred onto the sheet P at the printing section 2.

The printing section 2 forms a toner image on the sheet P fed from the feeding section 15. The printing section 2 comprises image forming units 22 (22Y, 22M, 22C, 22K), optical scanning devices 6 (6Y, 6M, 6C, 6K), transfer devices 8 (8Y, 8M, 8C, 8K), an intermediate transfer belt 11, a driving roller 12, a driven roller 13, a secondary transfer roller 14 and a cleaning device 18. The image forming units 22 (22Y, 22M, 22C, 22K) each have a photosensitive drum 4 (4Y, 4M, 4C, 4K), a charger 5 (5Y, 5M, 5C, 5K), a developing device 7 (7Y, 7M, 7C, 7K), a cleaner 9 (9Y, 9M, 9C, 9K), an eraser 10 (10Y, 10M, 10C, 10K) and a DC source 30 (30Y, 30M, 30C, 30K).

The photosensitive drums 4 are cylindrical, and as shown in FIG. 1, each of the photosensitive drums 4 rotates clockwise. Accordingly, the peripheral surface (photoreceptor surface) of the photosensitive drum 4 travels in a specified direction in a development area. The development area means an area where the photosensitive drum 4 and a developing roller 72 of the developing device 7 face to each other, and development from an electrostatic latent image into a toner image is performed in the development area.

The chargers 5 charge the peripheral surfaces of the photosensitive drums 4. The optical scanning devices 6 are controlled by a control section (not shown) to scan the peripheral surfaces of the photosensitive drums 4 with beams BY, BM, BC and BK. Thereby, electrostatic latent images are formed on the peripheral surfaces of the photosensitive drums 4.

The developing devices 7 provide toner to the photosensitive drums 4. The DC sources 30 apply DC voltages to the developing devices 7, and toner moves from the developing devices 7 to the photosensitive drums 4. Thereby, the electrostatic latent images on the photosensitive drums 4 are developed into toner images. A detailed description of the developing devices 7 and the DC sources 30 will be given later.

The intermediate transfer belt 11 is stretched between the driving roller 12 and the driven roller 13 and receives the toner images transferred from the photosensitive drums 4. The transfer devices 8 are located in such positions to face to the inner surface of the intermediate transfer belt 11. First transfer voltages are applied to the transfer devices 8, and thereby, the toner images formed on the photosensitive drums 4 are transferred onto the intermediate transfer belt 11 and are combined into a composite color image (primary transfer). The cleaners 9 collect residual toner from the peripheral surfaces of the photosensitive drums 4 after the first transfer. The erasers 10 eliminate the charges from the peripheral surfaces of the photosensitive drums 4. The driving roller 12 is rotated by an intermediate transfer belt driving section (not shown) and drives the intermediate transfer belt 11 in a direction shown by arrow $\alpha$. Thereby, the intermediate transfer belt 11 carries the composite toner image to the secondary transfer roller 14.

The secondary transfer roller 14, which is cylindrical, is located in such a position to face to the intermediate transfer roller 11. A secondary transfer voltage is applied to the secondary transfer roller 14, and thereby, the composite toner image carried by the intermediate transfer belt 11 is transferred onto a sheet P passing through between the intermediate transfer belt 11 and the secondary transfer roller 14 (secondary transfer). Specifically, the driving roller 12 keeps the ground potential, and the intermediate transfer belt 11 keeps a positive potential close to the ground potential because the intermediate transfer belt 11 is in contact with the driving roller 12. Then, a positive voltage is applied to the secondary transfer roller 14 as the secondary transfer voltage such that the potential of the secondary transfer roller 14 becomes higher than the potentials of the driving roller 12 and the intermediate transfer belt 11. The toner image has a negative potential. Therefore, by the effect of an electric field generated between the driving roller 12 and the secondary transfer roller 14, the toner image is transferred from the intermediate transfer belt 11 to the sheet P.

After the secondary transfer of the toner image onto the sheet P, the cleaning device 18 eliminates toner from the intermediate transfer belt 11.

The sheet P with the toner image transferred thereon is fed to the fixing device 20. The fixing device 20 performs a heating treatment and a pressing treatment toward the sheet P, and thereby, the toner image is fixed on the sheet P. Thereafter, the sheet P is ejected onto the printed-sheet tray 21.

Structure of the Developing Devices

Figure 2:
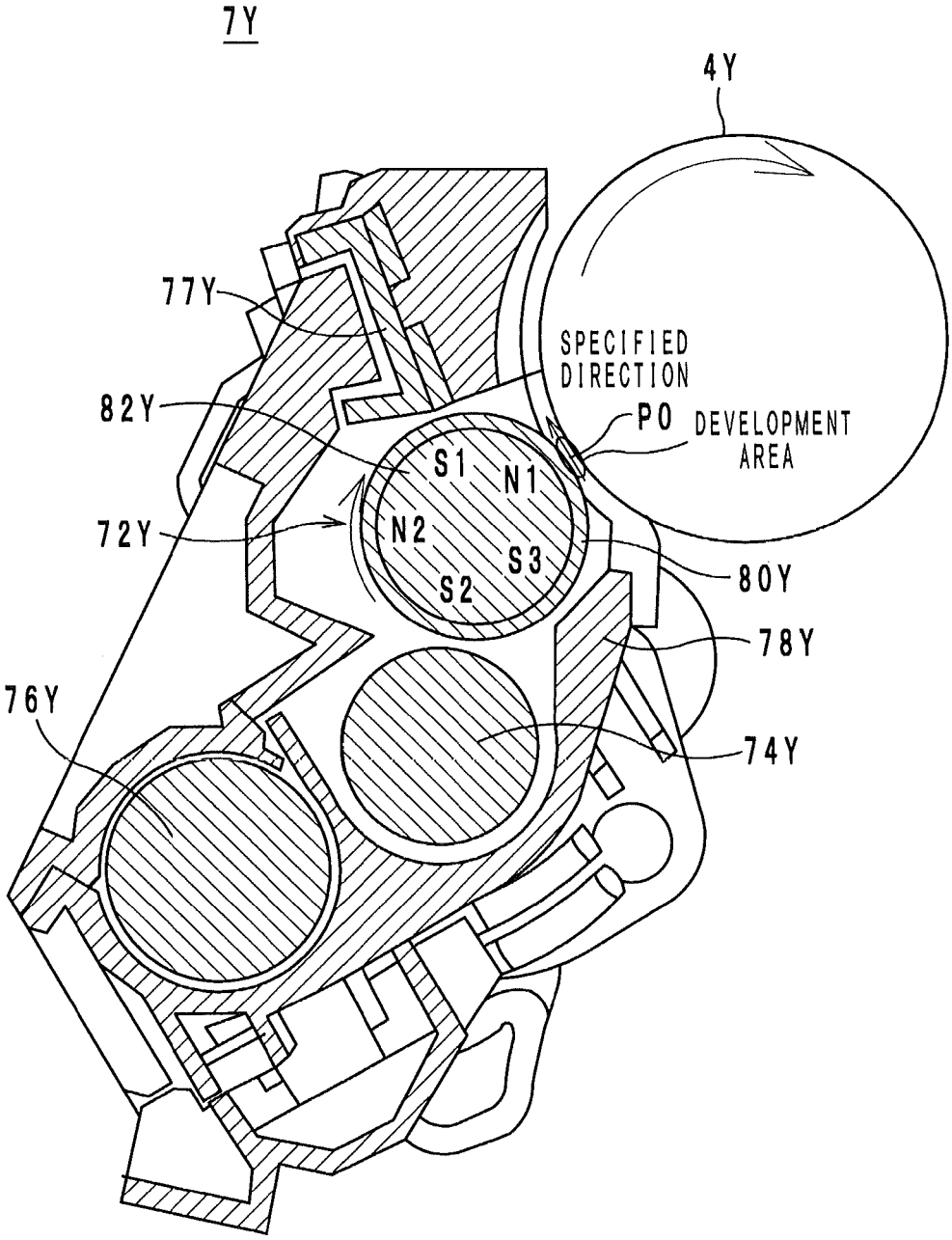
FIG. 2 is a sectional view of a developing device.

Next, the structure of the developing devices 7 (7Y, 7M, 7C, 7K) is described with reference to the drawings. FIG. 2 is a sectional view of the developing device 7Y. The developing devices 7Y, 7M, 7C and 7K are of the same structure, and in the following, the developing device 7Y is described as an example.

As shown in FIG. 2, the developing device 7Y comprises a developing roller 72Y, a supplying roller 74Y, a stirring roller 76Y, a blade 77Y and a container 78Y.

The container 78Y is the body of the developing device 7Y. In the container 78Y, toner is contained, and the developing roller 72Y, the supplying roller 74Y, the stirring roller 76Y and the blade 77Y are housed. The stirring roller 76Y stirs a developer contained in the container 78Y to charge the developer to a negative potential. The supplying roller 74Y supplies the developer to the developing roller 72Y. The developing roller 72Y provides toner to the peripheral surface of the photosensitive drum 4Y. The developing roller 72Y is composed of a sleeve 80Y and a magnet 82Y.

As shown in FIG. 2, the sleeve 80Y is a nonmagnetic metal cylinder and is located in such a position to face to the photosensitive drum 4Y. The sleeve 80Y rotates in the same direction as the photosensitive drum 4Y does, that is, the sleeve 80Y rotates clockwise. Thus, the photosensitive drum 4Y and the sleeve 80Y rotate to counter each other. In the development area, the peripheral surface of the sleeve 80Y travels in the opposite direction to the peripheral surface of the photosensitive drum 4Y.

The magnet 82Y is located inside the sleeve 80Y and has magnetic poles N1, S1, N2, S2 and S3 to form magnetic fields. The magnet 82Y attracts the magnetic carriers of the developer onto its peripheral surface by the effect of the magnetic fields, and thereby, the developer is held on the peripheral surface of the sleeve 80Y. Specifically, the magnetic pole N1 is a principal pole for development and is located to face to the photosensitive drum 4Y. In the magnet 82Y, the magnetic poles N1, S1, N2, S2 and S3 are arranged counterclockwise in this order.

In the developing roller 72Y of this structure, the magnetic carriers are attracted by the magnetic pole S2 onto the peripheral surface of the sleeve 80Y. In this moment, toner stuck on the magnetic carriers is also attracted onto the peripheral surface of the sleeve 80Y. Thus, the developer is attracted onto the peripheral surface of the sleeve 80Y and is conveyed by rotation of the sleeve 80Y. In the meantime, the developer keeps attracted onto the peripheral surface of the sleeve 80Y by the effects of a magnetic field generated between the magnetic poles S2 and N2, a magnetic field generated between the magnetic poles N2 and S1 and a magnetic field generated between the magnetic poles S1 and N1. The blade 77Y is located upstream, with respect to the rotating direction of the sleeve 80Y, from the position where the photosensitive drum 4Y and the sleeve 80Y face to each other, and the blade 77Y is at a specified distance from the peripheral surface of the sleeve 80Y. Thereby, the developer held on the peripheral surface of the sleeve 80Y is regulated to a specified thickness while passing the space between the blade 77Y and the sleeve 80Y. Further, as will be described later, the toner of the developer moves from the peripheral surface of the sleeve 80Y to the peripheral surface of the photosensitive drum 4Y by the effect of an electric field generated between the photosensitive drum 4Y and the sleeve 80Y. Thereby, the electrostatic latent image on the photosensitive drum 4Y is developed into a toner image.

After the developer passes through between the photosensitive drum 4Y and the sleeve 80Y, the developer is conveyed further while being still held on the peripheral surface of the sleeve 80Y by the effect of the magnetic field between the magnetic poles N1 and S3. Thereafter, in the weak magnetic field between the magnetic poles S3 and S2, the developer comes off from the peripheral surface of the sleeve 80Y by the centrifugal force.

Now, the process of developing the electrostatic latent image on the photosensitive drum 4Y into a toner image is described in more detail. The DC source 30Y applies a DC voltage to the sleeve 80Y so that the electrostatic latent image can be developed with the toner of the developer held on the peripheral surface of the sleeve 80Y. More specifically, the charger 5Y charges the peripheral surface of the photosensitive drum 4Y to a potential of −650V. When the peripheral surface of the photosensitive drum 4Y is scanned with the beam BY, the exposed portion of the photosensitive drum 4Y becomes nearly equal to 0V. In the meantime, the DC source 30Y charges the peripheral surface of the sleeve 80Y to a potential of −500V. Thereby, between the exposed portion of the photosensitive drum 4Y and the peripheral surface of the sleeve 80Y, an electric field of which direction is from the exposed portion of the photosensitive drum 4Y to the peripheral surface of the sleeve 80Y is generated. Therefore, the toner, which is negatively charged, moves from the peripheral surface of the sleeve 80Y to the exposed portion of the photosensitive drum 4Y. On the other hand, between non-exposed portion of the photosensitive drum 4Y and the peripheral surface of the sleeve 80Y, an electric field of which direction is from the peripheral surface of the sleeve 80Y to the non-exposed portion of the photosensitive drum 4Y is generated. Therefore, the toner, which is negatively charged, does not move from the peripheral surface of the sleeve 80Y to the non-exposed portion of the photosensitive drum 4Y. In this way, a toner image in conformity with the electrostatic latent image is formed on the photosensitive drum 4Y.

Further, the image forming apparatus 1 is designed to prevent toner images formed thereby from having density unevenness and stripe noise. Such designs are hereinafter described.

Prevention of Density Unevenness and Stripe Noise

In the image forming apparatus 1, a DC voltage is applied to the peripheral surface of the sleeve 80Y, and an AC voltage is not applied thereto. In other words, the image forming apparatus 1 adopts the DC development. In the DC development method, only a relatively small voltage is applied between the peripheral surface of the sleeve 80Y and the peripheral surface of the photosensitive drum 4Y, and only a relatively small amount of toner contributes to the development. Therefore, toner images formed thereby are prone to density unevenness.

Figure 3:
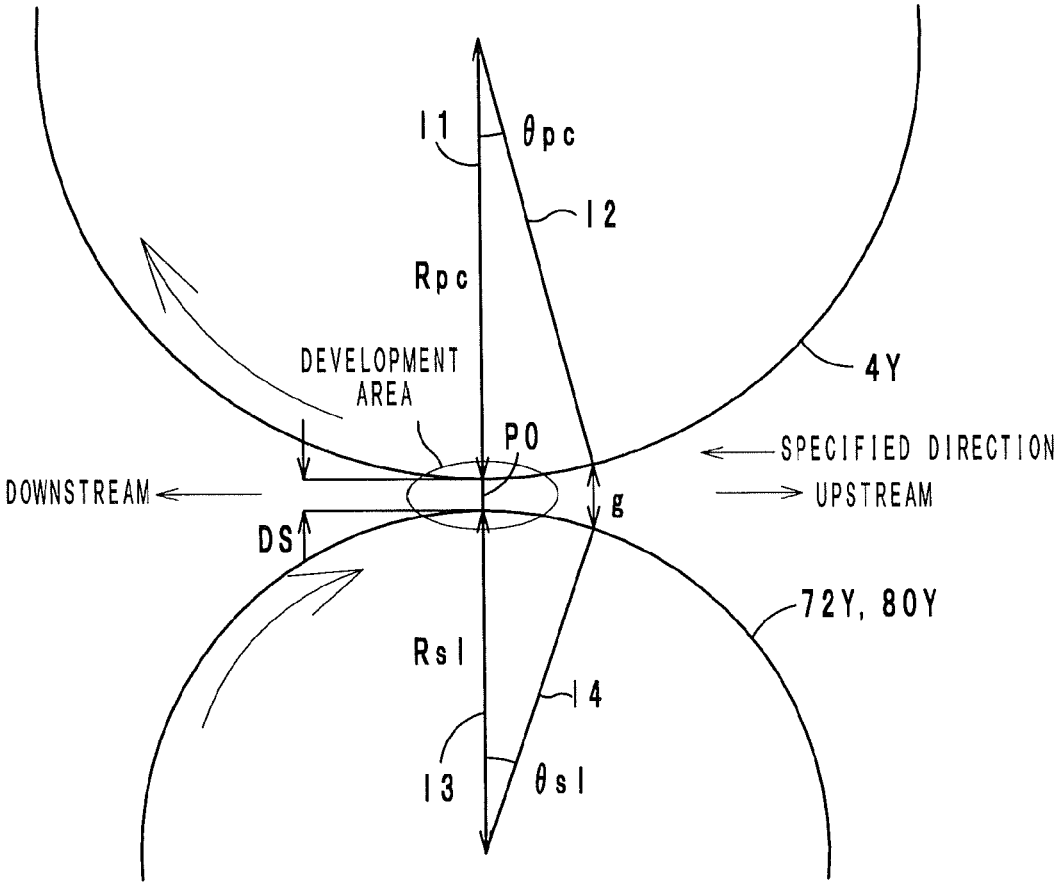
FIG. 3 is an enlarged view of a development area between a developing roller and a photosensitive drum, and the vicinity thereof.

In order to prevent density unevenness from occurring on toner images formed by the image forming apparatus 1 adopting the DC development method, the present inventors conceived of the idea of heightening a packing density. The packing density is hereinafter described with reference to FIG. 3. FIG. 3 is an enlarged view of the development area between the developing roller 72Y and the photosensitive drum 4Y, and the vicinity thereof.

The packing density (PD) means the degree of packing of the developer in the space between the sleeve 80Y and the photosensitive drum 4Y. The packing density is calculated from the amount of developer adhering to a unit area of the peripheral surface of the sleeve 80Y (MA ($g/m^2$)), the density of the developer ($\rho$ ($g/m^3$)) and the gap between the peripheral surface of the sleeve 80Y and the peripheral surface of the photosensitive drum 4Y in the packing density calculating position (g (m)), by use of the following expression (1).

$$PD=MA/\rho/g \quad (1)$$

The measurement of the value MA is performed, in a state where the photosensitive drum 4Y is not set, by averaging the weight of the developer adhering to the area subjected to the packing density calculation. More specifically, the sleeve 80Y is covered with a mask having an opening of 10 mm in a circumferential direction of the sleeve 80Y by 50 mm in a lengthwise direction of the sleeve 80Y. Then, the developer within the opening is sucked up, and the weight of the developer is measured. The value MA is calculated by dividing the weight of the developer by the area of the opening.

The value ρ is calculated by use of the following expression (2).

$$\rho = Tc \cdot \rho t + (1 - Tc) \cdot \rho c \quad (2)$$

Tc: ratio by weight of toner to the developer

ρt: density of toner

ρc: density of carriers

The value g is calculated by use of the following expression (3).

$$g = DS + Rpc \cdot (1 - \cos \theta pc) + Rsl \cdot (1 - \cos \theta sl) \quad (3)$$

DS: distance between the peripheral surface of the sleeve 80Y and the peripheral surface of the photosensitive drum 4Y at the point where the peripheral surface of the sleeve 80Y and the peripheral surface of the photosensitive drum 4Y become closest to each other (the closest point P0)

Rpc: radius of the photosensitive drum 4Y

Figure 4:
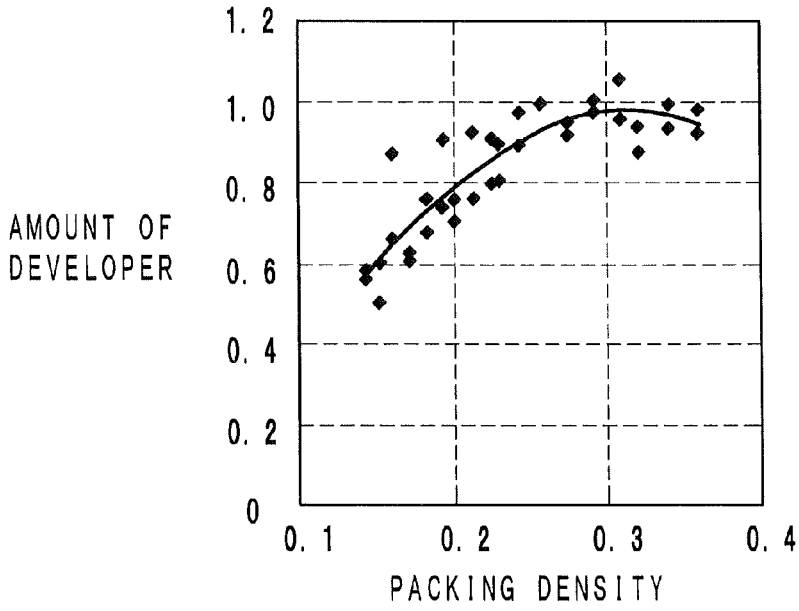
FIG. 4 is a graph showing results of a first experiment.

Rsl: radius of the developing roller 72Y

θpc: angle of a line l1 extending from the center of the photosensitive drum 4Y to the closest point P0 to a line l2 extending from the center of the photosensitive drum 4Y to the packing density calculating position θsl: angle of a line l3 extending from the center of the developing roller 72Y to the closest point P0 to a line l4 extending from the center of the developing roller 72Y to the packing density calculating position The present inventors conducted a first experiment to examine changes in the amount of developer adhering to a sheet P with changes in the packing density at the closest point P0. FIG. 4 is a graph showing results of the first experiment. In the graph of FIG. 4, the x axis shows packing density, and the y axis shows the amount of developer adhering to s sheet P.

The first experiment and other experiments (which will be describer later) were conducted under the following conditions:

MA=350 g/m$^2$

Tc=7%

DS=250 μm

Rpc=15 mm

Rsl=8 mm

ρt=110000 g/m$^3$

ρc=500000 g/m$^3$

It is apparent from FIG. 4 that the higher the packing density, the greater the amount of developer adhering to a sheet P. Then, the inventors conducted a second experiment to examine density unevenness and stripe noise on toner images while changing the packing density from 0.2 to 0.4 in increments of 0.05. Table 1 shows results of the second experiment. In Table 1, "A" means that density unevenness or stripe noise did not occur. "B" means that density unevenness or stripe noise that would not be a problem occurred. "C" means that density unevenness or stripe noise that would be a problem occurred.

TABLE 1

| PD | Density Unevenness | Stripe Noise |
|---|---|---|
| 0.2 | C | A |
| 0.25 | C | A |
| 0.3 | B | C |
| 0.35 | A | C |
| 0.4 | A | C |

Table 1 shows that when the packing density at the closest point P0 was within the range from 0.3 to 0.4, density unevenness that would be a problem did not occur. Meanwhile, when the packing density is greater than 0.4, the degree of packing of developer is too high, which inhibits movements of the developing roller 72Y and the photosensitive drum 4Y. Therefore, the experiment did not conducted under the conditions of packing densities higher than 0.4.

Next, the inventors conducted a third experiment to examine development stability while shifting the point of the maximum magnetic flux density of the magnetic pole N1 to an upstream side from the closest point P0 with respect to the specified direction.

The development stability means the incidence of density unevenness on toner images. Specifically, high development stability means that density unevenness is less likely to occur, and low development stability means that density unevenness is more likely to occur.

Now, the way of calculating the development stability is described. In the third experiment to examine the development stability, standard S/N ratio was used. In the field of quality engineering, S/N ratio is used as a measure of variability, and a large S/N ratio means small variability. The standard S/N ratio is an S/N ratio to be compared with a standard value. In order to calculate a standard value used for the third experiment, the amount of developer adhering to a sheet relative to the development voltage was examined while DS (the distance between the peripheral surface of the sleeve 80Y and the peripheral surface of the photosensitive drum 4Y at the closest point P0) was changed. More specifically, the distance DS was set to 250 μm and to 400 μm. In each of the cases where DS=250 μm and DS=400 μm, while the developing bias was changed from −100V to −500V in increments of 100V as input values, the transmission densities of solid images formed with the respective voltages applied were measured as output values. The average of the output value when DS=250 μm and the output value when DS=400 μm was determined as a standard output value. Then, in the third experiment, the variability (standard S/N ratio) from the standard output value (standard value) was measured while the point of the maximum magnetic flux density of the magnetic pole N1 was shifted to the upstream side from the closest point P0 with respect to the specified direction.

Figure 5:
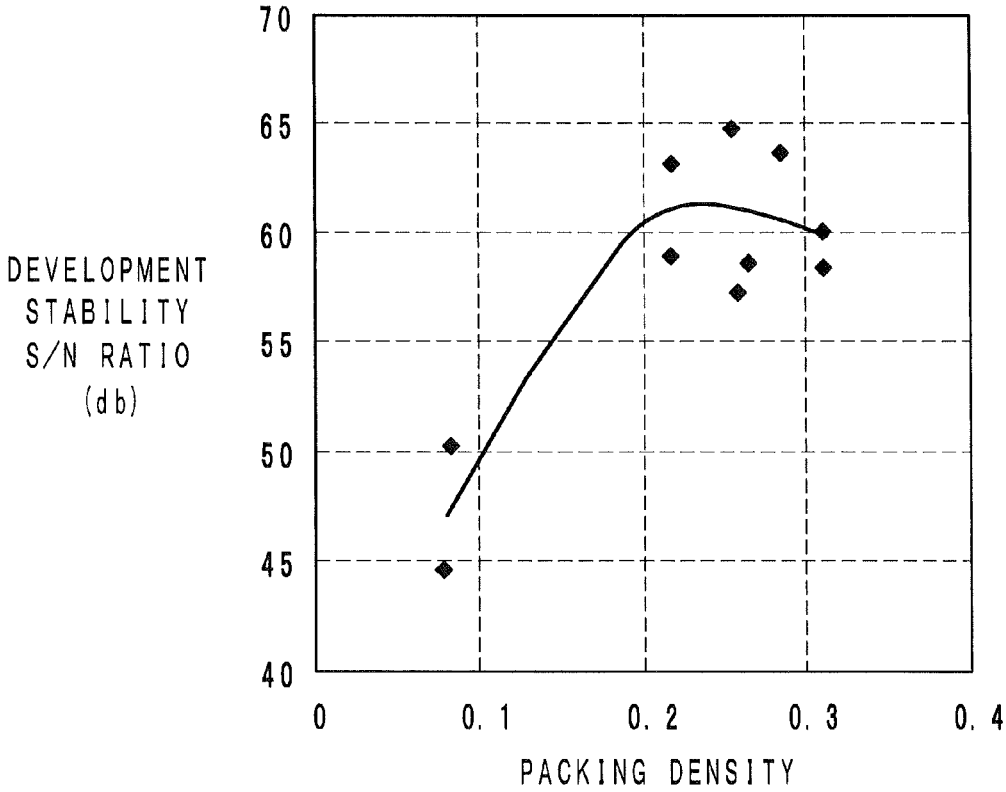
FIG. 5 is a graph showing results of a third experiment.

FIG. 5 is a graph showing results of the third experiment. In the graph of FIG. 5, the x axis shows the packing density at the point of the maximum magnetic flux density of the magnetic pole N1, and the y-axis shows the development stability S/N ratio. The third experiment was conducted under the condition that the packing density at the closest point P0 was 0.35.

As shown by FIG. 5, when the point of the maximum magnetic flux density of the magnetic pole N1 was located in the upstream side and within an area where the packing density was equal to or greater than 0.2, the development stability reached a peak. When the point of the maximum magnetic flux density of the magnetic pole N1 was located in the upstream side and within an area where the packing density was lower than 0.2, the development stability worsened rapidly. FIG. 5 shows that especially when the point of the maximum magnetic flux density of the magnetic pole N1 was located in the upstream side and at the point where the packing density was 0.22, the development stability was the highest. According to the results of the third experiment, it is preferred that the point of the maximum magnetic flux density of the magnetic pole N1 is located upstream from the closest point P0 and within an area where the packing density is equal to or greater than 0.2. Further, it is apparent from FIG. 5 that the upper limit of the packing density is 0.31.

Figure 6:
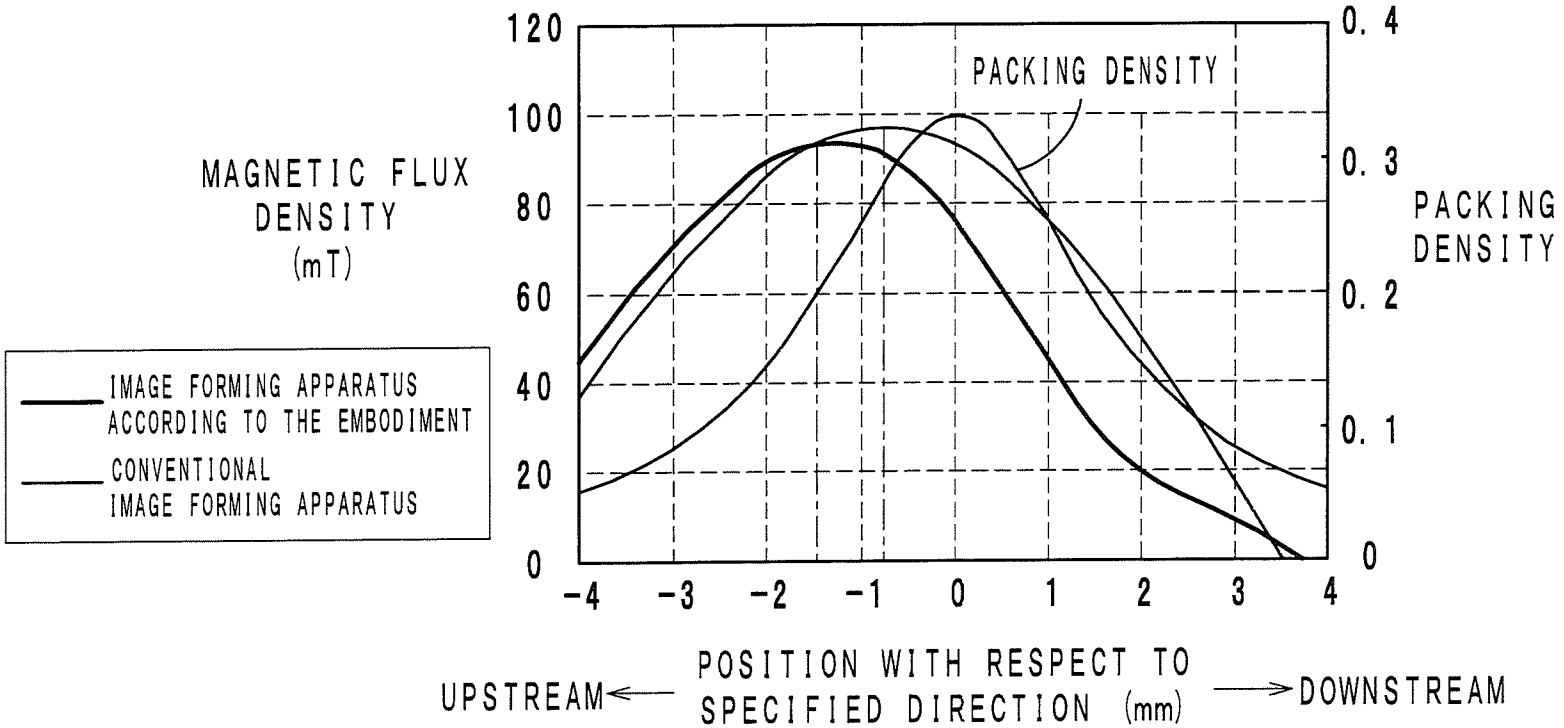
FIG. 6 is a graph showing the relation between the position with respect to the rotating direction of the photosensitive drum and the magnetic flux density of a magnetic pole N1 and the relation between the position with respect to the rotating direction of the photosensitive drum and the packing density.

FIG. 6 is a graph showing the relation between the position with respect to the specified direction and the magnetic flux density of the magnetic pole N1 and the relation between the position with respect to the specified direction and the packing density. In the graph of FIG. 6, the x axis shows the position with respect to the specified direction, and the y axis shows the magnetic flux density and the packing density.

As shown in FIG. 6, the packing density is the highest at the closest point P0 (position of 0 mm), and the farther from the closest point P0, the lower the packing density. The maximum magnetic flux density of the magnetic pole N1 is located in the upstream side from the closest point P0 with respect to the specified direction and at a point where the packing density is 0.2. Thus, in the image forming apparatus 1, the maximum magnetic flux density of the magnetic pole N1 is located at a point 1.5 mm upstream from the closest point P0 with respect to the specified direction.

In a conventional image forming apparatus (for example, in the apparatus disclosed by Japanese Patent Laid-Open Publication No. 2009-98593), the maximum magnetic flux density of the magnetic pole N1 is located at a point 0.7 mm upstream from the closest point P0 with respect to the specified direction. Thus, the point of the maximum magnetic flux density of the magnetic pole N1 in the image forming apparatus 1 is located at a point more upstream from the closest point P0 than that in a conventional image forming apparatus. With this design, the image forming apparatus 1 achieves improved development stability.

With regard to stripe noise, Table 1 shows that when the packing density at the closest point P0 was within the range from 0.3 to 0.4, stripe noise that would be a problem occurred. When the packing density at the closest point P0 was within the range from 0.2 to 0.25, stripe noise did not occur. This is because the carriers of the developer come into contact with the toner image when the packing density is high, which causes stripe noise in the trailing portion of the toner image.

Figure 7:
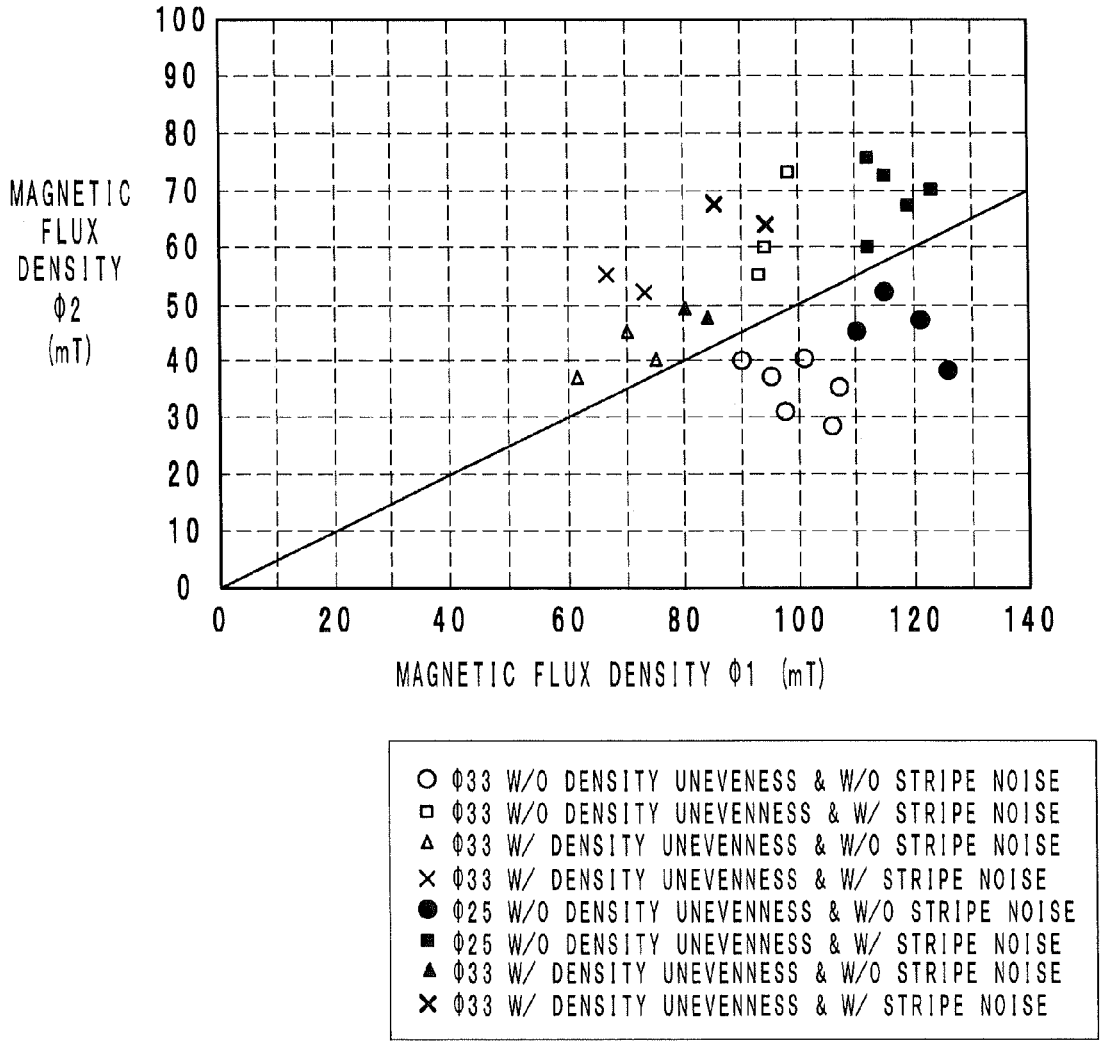
FIG. 7 is a graph showing results of a fourth experiment.

Then, the inventors conducted a fourth experiment, focusing on the relation between the magnetic flux density in the upstream side from the closest point P0 and that in the downstream side from the closest point P0. In the fourth experiment, specifically, the inventors examined density unevenness and stripe noise on toner images while changing the magnetic flux density $\phi$1 at the point in the upstream side where the packing density was 0.2 and the magnetic flux density $\phi$2 at the point in the downstream side where the packing density was 0.2. Further, the fourth experiment was conducted under the condition that carriers with diameters of 25 μm were used and under the condition that carriers with diameters of 33 μm were used. FIG. 7 is a graph showing results of the fourth experiment. In the graph of FIG. 7, the x axis shows the magnetic flux density $\phi$1, and the y axis shows the magnetic flux density $\phi$2.

FIG. 7 shows that when the magnetic flux density $\phi$2 was equal to or less than ½ of the magnetic flux density $\phi$1, neither density unevenness nor stripe noise occurred. On the other hand, when the magnetic flux density $\phi$2 was greater than ½ of the magnetic flux density $\phi$1, density unevenness and/or stripe noise occurred. Hence, in order to prevent density unevenness and stripe noise, the magnetic flux density $\phi$2 should be set equal to or less than ½ of the magnetic flux density $\phi$1.

The results of the first to fourth experiments show that the image forming apparatus 1 must meet the following three conditions to prevent density unevenness and stripe noise.

The first condition is that the packing density at the closest point P0 is within the range from 0.3 to 0.4. The second condition is that the maximum magnetic flux density of the magnetic pole N1 is located at a point upstream from the closest point P0 where the packing density is equal to or greater than 0.2. The third condition is that the magnetic flux density $\phi$2 at the point where the packing density is 0.2 in the downstream side from the closest point P0 with respect to the specified direction is equal to or less than ½ of the magnetic flux density $\phi$1 at the point where the packing density is 0.2 in the upstream side from the closest point P0 with respect to the specified direction.

Further, the inventors produced an image forming apparatus that met the second and the third conditions and conducted a fifth experiment by using the image forming apparatus to examine density unevenness and stripe noise on toner images while changing the packing density at the closest point P0 from 0.2 to 0.4 in increments of 0.05. The fifth experiment differs from the second experiment in that the image forming apparatus used in the second experiment did not meet the second and the third conditions while the image forming apparatus used in the fifth experiment met the second and the third conditions. More specifically, in the image forming apparatus used in the second experiment, the maximum magnetic flux density of the magnetic pole N1 was located at the closest point P0, and the magnetic flux density $\phi$1 and the magnetic flux density $\phi$2 were equal to each other.

Table 2 shows results of the fifth experiment. In Table 2, "A" means that density unevenness or stripe noise did not occur. "B" means that density unevenness or stripe noise that would not be a problem occurred. "C" means that density unevenness or stripe noise that would be a problem occurred.

TABLE 2

| PD | Density Unevenness | Stripe Noise |
|---|---|---|
| 0.2 | C | A |
| 0.25 | C | A |
| 0.3 | B | A |
| 0.35 | A | A |
| 0.4 | A | B |

Table 2 shows that when the packing density at the closest point P0 was within the range from 0.3 to 0.4, neither density unevenness that would be a problem nor stripe noise that would be a problem occurred. Hence, the image forming apparatus 1 can prevent density unevenness by meeting the first condition, and can prevent stripe noise by meeting the second and the third conditions.

Figure 8:
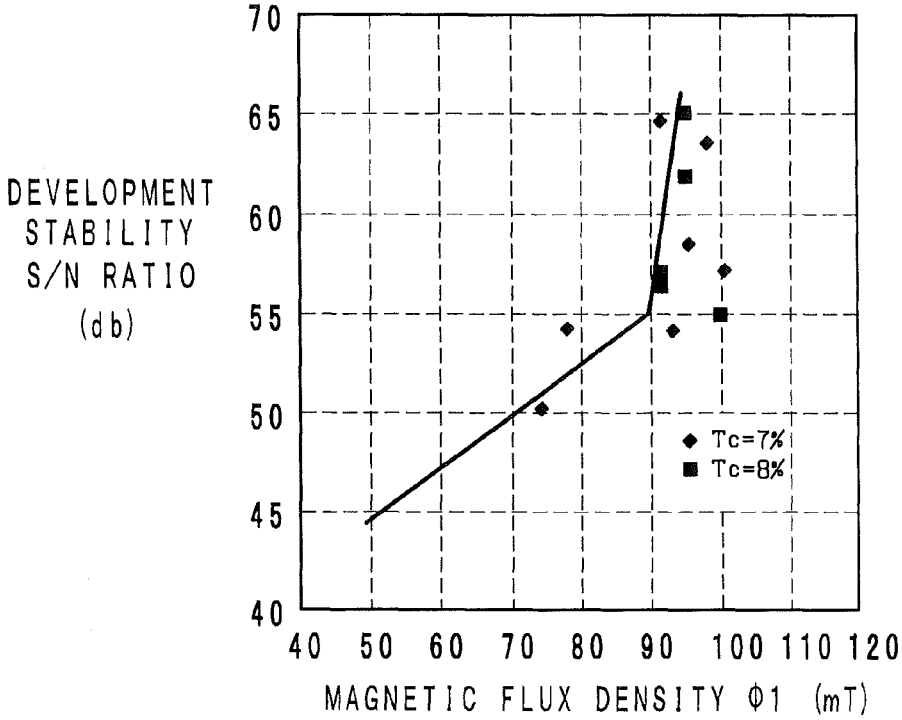
FIG. 8 is a graph showing results of a sixth experiment.

Next, the inventors conducted a sixth experiment to determine a suitable value for the magnetic flux density $\phi$1. Specifically, the inventors examined development stability while changing the magnetic flux density $\phi$1. FIG. 8 is a graph showing results of the sixth experiment. In the graph of FIG. 8, the x axis shows the magnetic flux density $\phi$1, and the y axis shows the development stability.

In FIG. 8, the slope in the area where the magnetic flux density $\phi$1 is equal to or greater than 90 mT is greater than the slope in the area where the magnetic flux density $\phi$1 is less than 90 mT. This means that the ratio of the improvement in development stability to the increase in magnetic flux density $\phi$1 in the area where the magnetic flux density $\phi$1 is equal to or greater than 90 mT is greater than that in the area where the magnetic flux density $\phi$1 is less than 90 mT. This is because when the magnetic flux density $\phi$1 is high, the developer is formed into a magnetic brush with a greater height on the peripheral surface of the sleeve 80Y, which ensures contact of the magnetic brush with the peripheral surface of the photosensitive drum 4Y. Then, the assured contact of the magnetic brush with the peripheral surface of the photosensitive drum 4Y results in that more toner is supplied from the peripheral surface of the sleeve 80Y to the peripheral surface of the photosensitive drum 4Y stably. Therefore, when the magnetic flux density $\phi 1$ is greater than 90 mT, the development stability is improved. Hence, the results of the sixth experiment show that the magnetic flux density $\phi 1$ is preferably equal to or greater than 90 mT.

Figure 9:
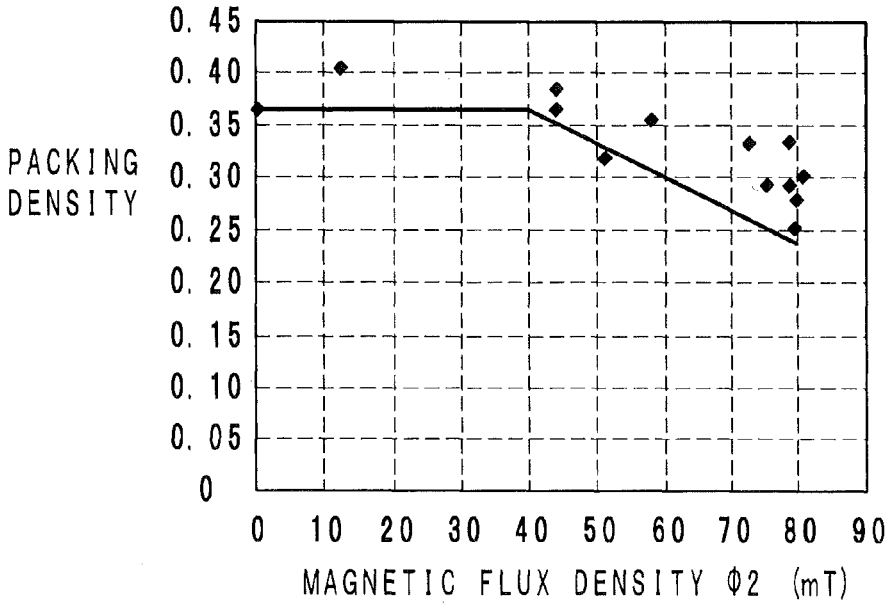
FIG. 9 is a graph showing results of a seventh experiment.

Next, the inventors conducted a seventh experiment to determine a suitable value for the magnetic flux density $\phi 2$. Specifically, the inventors measured the packing density at the closest point P0 when stripe noise occurred while changing the magnetic flux density $\phi 2$. FIG. 9 is a graph showing results of the seventh experiment. In the graph of FIG. 9, the x axis shows the magnetic flux density $\phi 2$, and the y axis shows the packing density at the closest point P0.

As shown in FIG. 9, in the area where the magnetic flux density $\phi 2$ was equal to or less than 40 mT, stripe noise occurred when the packing density at the closest point P0 was equal to or greater than 0.37. In the area where the magnetic flux density $\phi 2$ was greater than 40 mT, even when the packing density was less than 0.37, stripe noise occurred. Thus, under the condition that the magnetic flux density $\phi 2$ is greater than 40 mT, stripe noise is likely to occur even when the packing density is low. This is because when the magnetic flux density $\phi 2$ is great, the height of the magnetic brush in the downstream side from the closest point P0 with respect to the specified direction becomes great, which causes the magnetic brush to come into contact with the toner image that has passed the closest point P0. Therefore, the magnetic flux density $\phi 2$ is preferably equal to or less than 40 mT so that the height of the magnetic brush in the downstream side from the closest point P0 will be low. This design ensures prevention of stripe noise.

As described above, the image forming apparatus 1 according to the embodiment can prevent density unevenness and stripe noise from occurring on toner images formed thereby.

Although the present invention has been described in connection with the preferred embodiments above, it is to be noted that various changes and modifications are possible to those who are skilled in the art. Such changes and modifications are to be understood as being within the scope of the present invention.

What is claimed is:

1. An image forming apparatus for forming a toner image on a print medium with a developer composed of toner and carriers, said image forming apparatus comprising:

an image support member having a first peripheral surface for supporting an electrostatic latent image thereon, the first peripheral surface traveling in a specified direction in a development area;

a developing device comprising a developer support member having a second peripheral surface for supporting the developer thereon, the second peripheral surface traveling in a direction opposite to the first peripheral surface in the development area, the developer support member attracting the carriers of the developer by an effect of a magnetic field so as to hold the developer on the second peripheral surface; and a voltage applying device for applying a DC voltage to the second peripheral surface such that in the development area, the electrostatic latent image supported on the first peripheral surface is developed with the developer supported on the second peripheral surface;

wherein when a value calculated by performing a first division of an amount of the developer adhering to a unit area of the second peripheral surface by a density of the developer and further by performing a second division of a value resulting from the first division by a gap between the first peripheral surface and the second peripheral surface is defined as a packing density, the packing density at a closest point where the first peripheral surface and the second peripheral surface are the closest to each other is within a range from 0.3 to 0.4;

wherein a maximum magnetic flux density of a principal magnetic pole for generating the magnetic field for development is located in an upstream side that is a side upstream from the closest point with respect to the specified direction and at a point where the packing density is equal to or greater than 0.2; and wherein a magnetic flux density of the principal magnetic pole at a point where the packing density is 0.2 in a downstream side that is a side downstream from the closest point with respect to the specified direction is equal to or less than ½ of a magnetic flux density of the principal magnetic pole at a point where the packing density is 0.2 in the upstream side.

2. An image forming apparatus according to claim 1, wherein the magnetic flux density of the principal magnetic pole at the point where the packing density is 0.2 in the upstream side is equal to or greater than 90 mT; and wherein the magnetic flux density of the principal magnetic pole at the point where the packing density is 0.2 in the downstream side is equal to or less than 40 mT.

* * * * *